US005898357A

United States Patent [19]

Endo et al.

[11] Patent Number: 5,898,357

[45] Date of Patent: Apr. 27, 1999

[54] FUSE AND METHOD OF MANUFACTURING THE SAME

[75] Inventors: Takayoshi Endo; Takashi Ishii, both of Shizuoka; Naoki Matsuoka, Hjoyo, all of Japan

[73] Assignee: Yazaki Corporation, Tokyo, Japan

[21] Appl. No.: 08/987,424

[22] Filed: Dec. 9, 1997

[30] Foreign Application Priority Data

Dec. 12, 1996 [JP] Japan ..... 8-332251

[51] Int. Cl.[6] ..... H01H 85/11; H01H 85/08

[52] U.S. Cl. ..... 337/159; 337/160; 337/198

[58] Field of Search ..... 337/198, 152, 337/160, 216, 266, 270

[56] References Cited

FOREIGN PATENT DOCUMENTS 64-60937 3/1989 Japan ..... H01H 85/04

7-130277 5/1995 Japan ..... H01H 85/08

*Primary Examiner*—Leo P. Picard

*Assistant Examiner*—Anatoly Vortman

*Attorney, Agent, or Firm*—Sughrue, Mion, Zinn, MacPeak & Seas PLLC

[57] ABSTRACT

A fuse comprising: a fusible portion constituted by a connection portion which is formed of the same metal base material as a pair of terminals so as to connect the pain of terminals to each other, and a low-melting metal having a melting point lower than that of the connection portion and stacked by welding on at least a portion of the connection portion; and at least one protrusion formed on the fusible portion by making the connection portion and the low-melting metal project in a direction parallel to the plane of an interface between the connection portion and the low-melting metal. Further disclosed is a method of manufacturing the fuse. The fuse can be manufactured with a simple manufacturing process in comparison with a conventional method, and in the fuse, only the fusing-off time in a layer short-circuit range can be shortened by use of diffusion between the low-melting metal and base material.

6 Claims, 3 Drawing Sheets

FUSE AND METHOD OF MANUFACTURING THE SAME

BACKGROUND OF THE INVENTION

The present invention relates to fuses for protecting electric wires, equipments and so on from an overcurrent.

In electric circuits of automobiles or the like, conventionally, fuses were used to protect electric wires, equipments and so on from an overcurrent. JP-A-7-130277 discloses such a fuse in which a thin extension portion is formed in a fusible portion to improve the effect of collecting heat so as to obtain superior fusing-off property. In this fuse 1, as shown in FIG. 1, base portions 5 are provided on a pair of terminals 3 and 3 so as to project therefrom, and caulking protrusions 7 are provided at these base portions 5. The base portions 5 are connected to each other through a slender extension portion 9. After the opposite ends of a low-melting chip are fixed by the caulking protrusions 7, the low-melting chip is heated so as to be melted once, so that cohesive portions 13 and 13 which are a pair of increased-sectional-area portions are formed around the caulking protrusions 7 by the surface tension, while a thin extension portion 15 is formed at the center of the slender extension portion 9.

According to the thus configured fuse 1, the sectional area of the slender extension portion 9 is smaller than the sectional area of each of the cohesive portions 13 and 13 so that a sufficient constriction rate can be obtained. By the heat collecting effect of the constriction, it is easy to specify the position of a fusing portion and reduce a heating area. Accordingly, it is possible to specify a hot spot position and reduce a heating area, so that not only it is possible to restrain a fuse element from heating as a whole so as to reduce unnecessary heat transfer to the terminals 3 and 3 of a housing not shown and the surroundings thereof, but also it is possible to obtain superior fusing-off property in a low current range by effective use of heating.

However, generally, a fuse has a constant correlation between current conduction and fusing-off time. That is, while a fusible portion of a fuse element is fused off immediately in the case of short (dead short-circuit), for example, caused by a current of 200% or more of the rated current of the fuse, the fusible portion repeats heat generation and radiation in the case of a short-circuit caused by a current of 200% or less of the rated current of the fuse or in an intermittent short-circuit (layer short-circuit), so that there is a tendency to increase the fusing-off time. Under such conditions, electric wires constituting a circuit do not radiate heat as the fusible portion due to an insulating coating covering it even if the intermittent short current flows in the wires. Therefore the temperature continues to increase because of heat accumulation, and there is a fear that smoking or the like may be caused in the worst case.

For solving such a problem, there is a method in which a base material of a fuse element is diffused into low-melting metal to make the fusing-off temperature lower than the melting point of the base material to thereby shorten only the fusing-off time in a layer short-circuit range without changing the fusing-off property in a dead short-circuit range so as to improve the fusing-off property in the layer short-circuit range.

Since the thin extension portion 15 is formed at the center of the fusible portion in the above-mentioned conventional fuse 1 in order to increase the constriction rate, it is possible to obtain a heat collecting effect based on the constriction. It is, however, impossible to obtain a sufficient fusing amount of the low-melting metal, and it is therefore difficult to obtain an effect to shorten the fusing-off time on the basis of the diffusion.

In addition, in the above-mentioned conventional fuse 1, a low-melting chip is caulked by the caulking protrusions 7 after the terminals 3 and 3, the base portions 5 and the slender extension portion 9 are formed by pressing, and the low-melting chip is heated and melted to be welded to the slender extension portion 9. There is, therefore, a problem that the steps of coating with flux before welding, caulking, heating and melting the low-melting chip, cleaning the flux after welding, and so on are complicated so that the manufacturing cost is high.

SUMMARY OF THE INVENTION

It is therefore an object of the present invention to solve the foregoing problems.

It is another object of the present invention to provide a fuse and a method of manufacturing the same, in which the fusing-off time only in a layer short-circuit range can be reduced by use of the diffusion between a low-melting metal and a base material, and which can be manufactured with a simple manufacturing process in comparison with a conventional method so as to attain improvement of the reliability of fusing-off in the layer short-circuit range and reduction of the manufacturing cost.

In order to attain the foregoing objects, according to an aspect of the present invention, a fuse comprising:

a pair of terminals;

a fusible portion including; and a connection portion made of the same metal base material as the terminals for connecting the pair of terminals to each other, a low-melting metal portion made of a low-melting metal having a melting point lower than that of the connection portion and stacked by welding on at least a portion of the connection portion and;

wherein at least one protrusion is formed on the fusible portion by making the connection portion and the low-melting metal portion project in a direction parallel to the plane of an interface between the connection portion and the low-melting metal portion.

Preferably, the connection portion may be made of copper or a copper alloy, and the low-melting metal portion is made of tin.

According to another aspect of the present invention, the method of manufacturing a fuse comprises the steps of:

forming a groove in the surface of a plate-like base material;

melting a low-melting metal having a melting point lower than that of the plate-like base material so as to weld the low-melting metal to the groove; and integrally punching out the plate-like base material so that a pair of terminal portions are formed at portions of the plate-like base material on the opposite sides of the groove, a fusible portion is formed so as to connect the pair of terminal portions to each other at a where the low-melting metal is welded to the groove, and at least one protrusion formed by making portions of the low-melting metal and a bottom plate portion of the groove to project in a direction parallel to the plane of an interface between the low-melting metal and the bottom plate portion.

Preferably, the connection[]portion may be made of copper or a copper alloy, and the low-melting metal is tin.

In the thus configured fuse, the fusible portion is constituted by: the connection portion formed so as to connect a pair of terminals to each other; the low-melting metal portion stacked by welding onto this connection portion; and the protrusion connection portion formed at a portion where the low-melting metal is stacked by welding on the connection portion. Accordingly, it is possible to increase the amount of the low-melting metal without increasing the width of the connection portion. In addition, the outer circumferential areas of the base material and the low-melting metal are increased by the formation of the protrusion. Accordingly, the contact area between the base material and the low-melting metal is increased at the time of melting, so that it is possible to accelerate the diffusion.

When copper or a copper alloy is used as the material for the connection portion, and tin is used as the material for the low-melting metal, it is possible to manufacture the fuse with comparatively inexpensive materials.

In the method of manufacturing the fuse according to the present invention, the melted low-melting metal is poured into the groove of the plate-like base material so as to be welded thereto, and this plate-like base material is integrally punched out so as to form the terminals, the fusible portion and the protrusion thereof. Accordingly, it is possible to manufacture the fuse without steps of coating flux, caulking, heating and melting a low-melting chip, cleaning the flux, and so on which have been required in the conventional method.

DETAILED DESCRIPTION OF THE PREFERRED EMBODIMENT

A preferred embodiment of a fuse and a manufacturing method thereof according to the present invention will be described in detail below with reference to the drawings.

Figure 1:
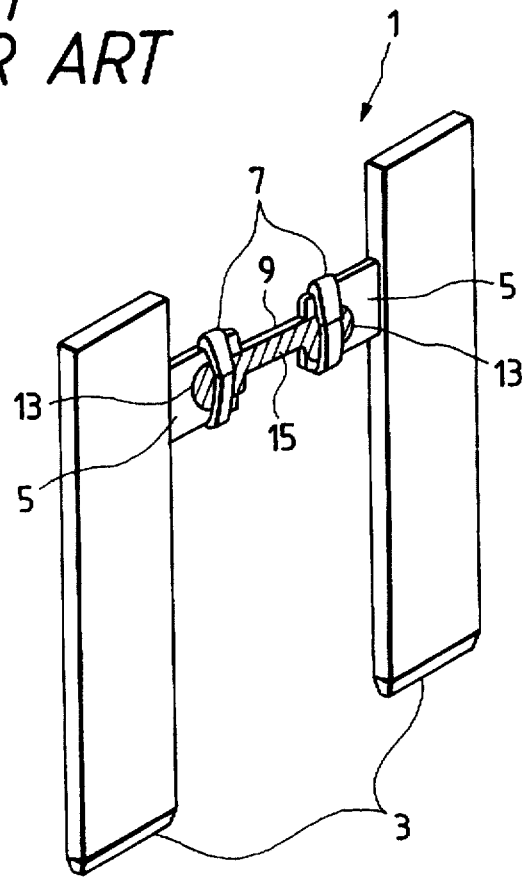
FIG. 1 PRIOR ART
FIG. 1 is a perspective view of an element portion of a conventional fuse.
Figure 2:
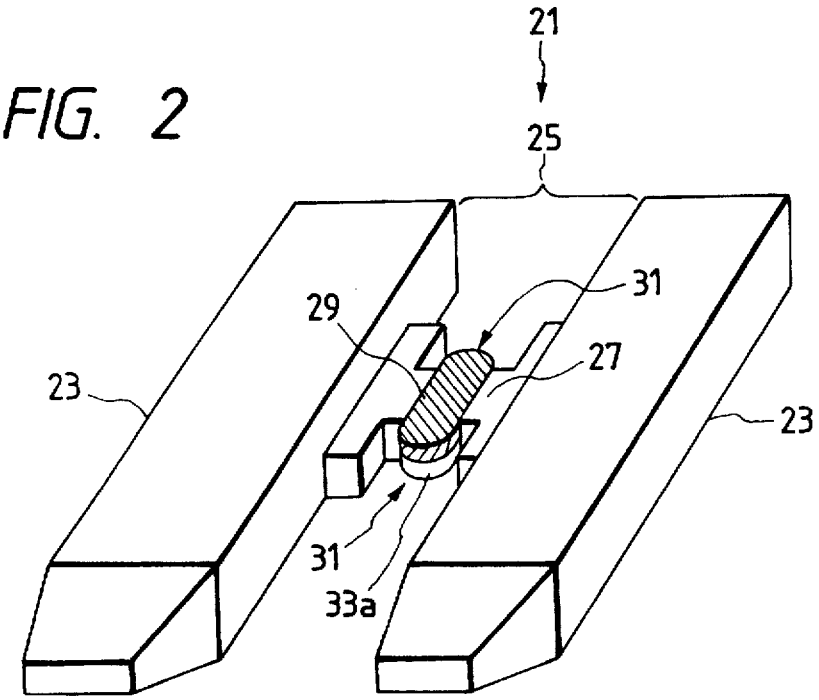
FIG. 2 is a perspective view of an element portion of a fuse according to the present invention.

FIG. 2 is a perspective view of an element portion of a fuse according to the present invention;

In a fuse 21, a pair of terminals 23 and 23 is connected to each other through a fusible portion 25. The fusible portion 25 is constituted by a connection portion 27 extended from the terminals 23 and 23 so as to connect the terminals 23 and 23 to each other, and a low-melting metal 29 is stacked by welding on at least a portion of this connection portion 27.

More specifically, the connection portion 27 has a bottom plate portion which is formed substantially at the center of the connection portion 27 so as to be thinner than any other portion. This bottom plate portion has a pair of protrusions 33*a* projected outward in the direction parallel the plane of the interface between the bottom plate portion of the connection portion 27 and the low-melting metal 29 stacked thereon, so that the bottom plate portion is shaped like an ellipse in plan view. The above-mentioned low-melting metal 29 is shaped like the same ellipse and is stacked by welding on this bottom plate portion. That is, the fusible portion 25 has protrusions 31 and 31 which respectively include the protrusions 33*a* and 33*a* of the bottom plate portion of the connection portion 27 and the protrusions of the low-melting metal 29 and which project in the direction parallel to the plane of the interface between the connection portion 27 and the low-melting metal 29 stacked by welding to each other.

Copper (Cu), a Cu alloy, zinc (Zn), a zinc alloy, etc. may be used as the base material for forming the terminals 23 and 23 and the connection portion 27. On the other hand, gold (Au), nickel (Ni), tin (Sn), etc. may be used as the material of the low-melting metal 29.

Figure 3A:
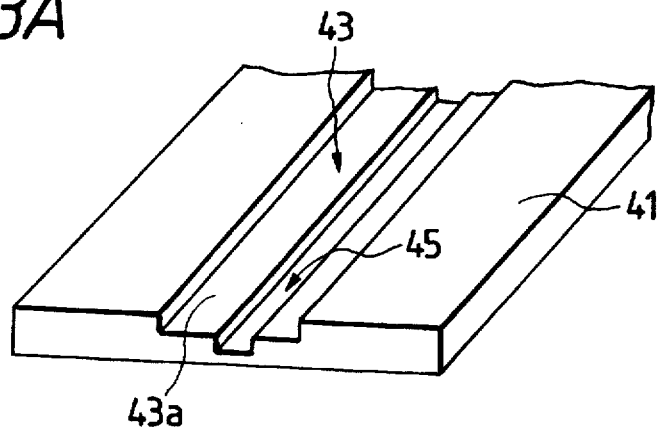
FIGS. 3A to 3C are explanatory views showing the steps A, B and C of the method of manufacturing a fuse according to the present invention.
Figure 3B:
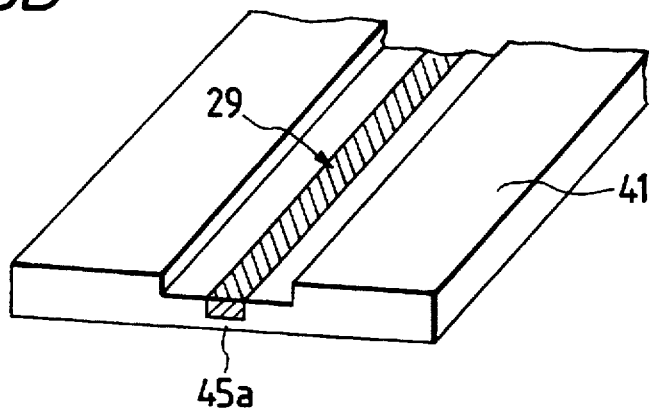
Figure 3C:
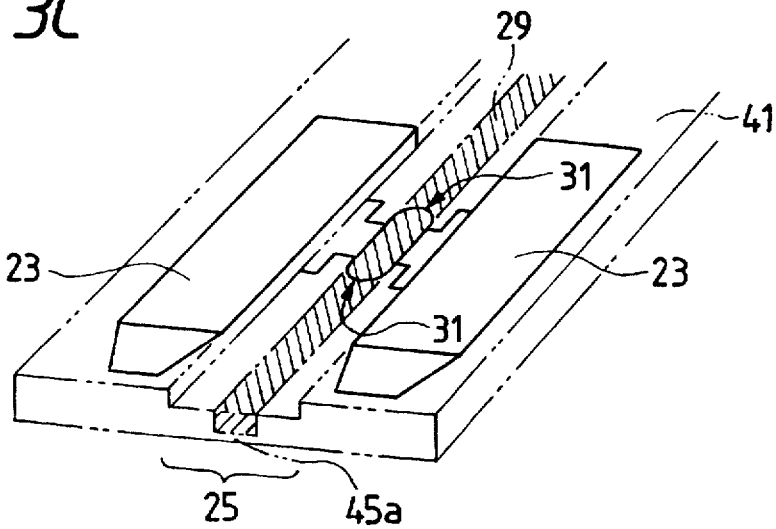

Next, the method of manufacturing the thus configured fuse 21 will be described with reference to FIG. 3. FIG. 3 is an explanatory view showing the steps A, B and C of the method of manufacturing a fuse according to the present invention.

In order to manufacture the fuse 21, first, as shown in the step A of FIG. 3, a groove 43 is formed in the surface of a plate-like base material 41 formed of Cu or the like, and then a groove 45 is formed in a bottom portion 43*a* of the groove 43. Alternatively, only the groove 45 may be formed in the surface of the plate-like base material 41.

Next, the low-melting metal 29 formed of, for example, Sn or the like having the melting point lower than that of the plate-like base material 41 is melted and poured into this groove 45. The low-melting metal 29 poured into the groove 45 is cooled and solidified so as to be stacked by welding onto the bottom plate portion 45*a* of the groove 45 as shown in the step B of FIG. 3.

Next, the base plate 41 is integrally punched out so that the portions of the plate-like base material 41 disposed on the opposite sides of the groove 43 are made into the pair of terminals 23 and 23, while the portion of the groove 43 and the low-melting metal 29 are made into the fusible portion 25. At this time, the low-melting metal 29 and the bottom plate portion 45*a* are punched out so as to project in the longitudinal direction of the groove 43. Thus, the protrusions 31 and 31 are provided in the fusible portion 25, and the process of manufacturing the element portion of the fuse 21 is completed.

Next, the operation of the fuse 21 will be described.

Figure 4:
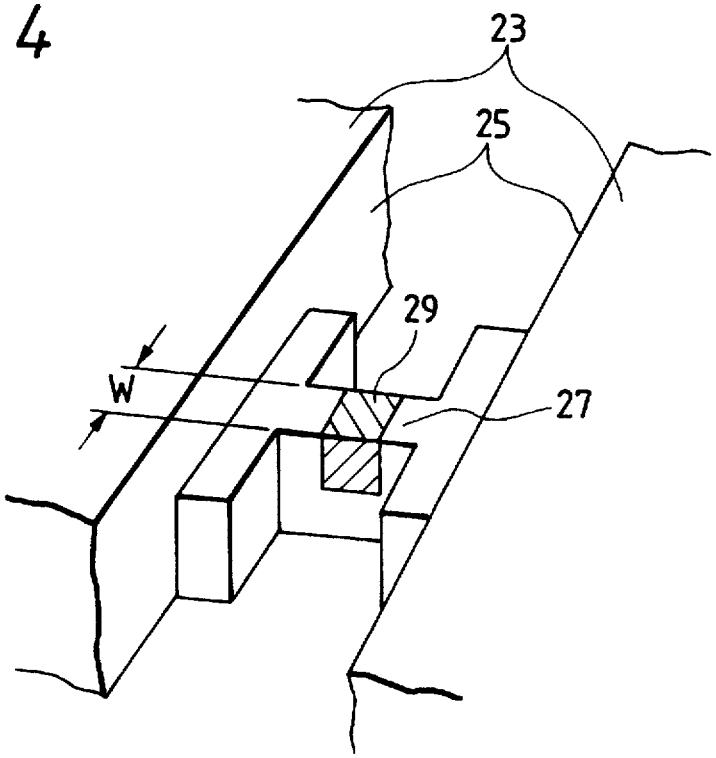
FIG. 4 is a perspective view of the fusible portion without providing any protrusion.
Figure 5:
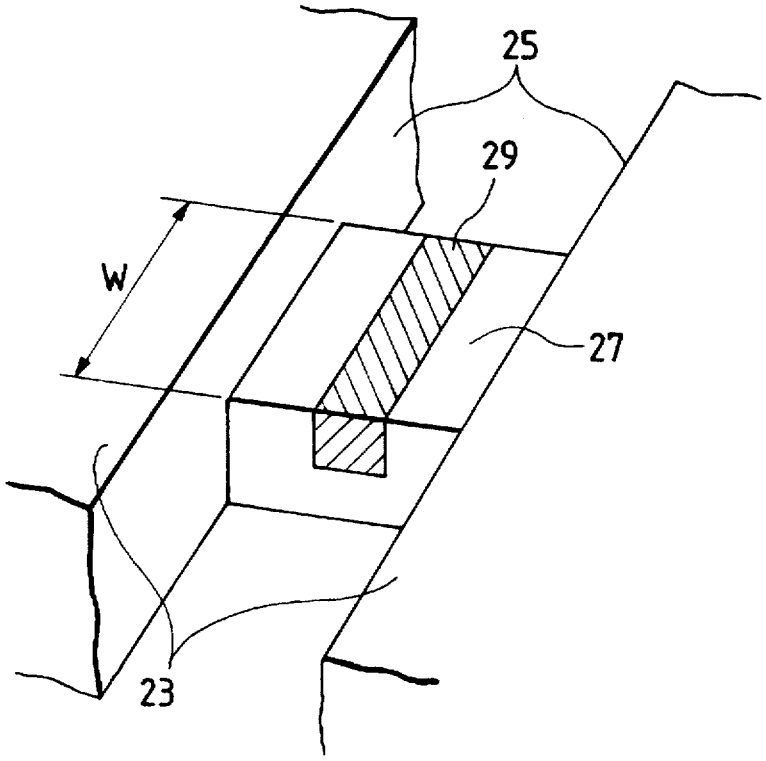
FIG. 5 is a perspective view of a fusible portion in the case where the width of the connection portion is increased.

FIG. 4 is a perspective view of the fuse having a fusible portion with no protrusion, and FIG. 5 is a perspective view of the fuse having a fusible portion in which the width of a connection portion is enlarged.

In the case of a fuse in which the low-melting metal (Sn or the like) 29 is welded to the bottom portion of the connection portion 27 (Cu or the like) to form the fusible portion 25, if the low-melting metal 29 and the bottom portions of the connection portion 27 have only the width W, as shown in FIG. 4, without providing the above-mentioned protrusions 31 and 31, a sufficient melting amount of the low-melting metal 29 cannot be obtained. It is therefore impossible to obtain an effect to shorten the fusing-off time based on diffusion.

If the width W of the connection portion 27 is increased, as shown in FIG. 5, without providing the above-mentioned protrusions 31 and 31, on the other hand, the melting amount of the low-melting metal 29 so increases that an effect to shorten the fusing-off time based on diffusion can be expected in a layer short range. However, since the width W of the connection portion 27 also increases simultaneously, the sectional area of the base material in the fusible portion 25 increases, so that there arises a problem that the fusing-off time increases in a dead short range.

On the other hand, in such a fuse 21 as shown in FIG. 2, because of the protrusions 31 and 31 formed in the fusible portion 25, the amount of the low-melting metal 29 relative to the base material of the connection portion 27 can be increased without increasing the width of the connection portion 27. Further, the outer circumferential areas of the base material and the low-melting metal 29 are increased because of the formation of the protrusions 31 and 31, so that the contact area of the base material with the low-melting metal 29 is increased at the time of melting. It is therefore possible to accelerate diffusion.

As has been described above, according to the fuse 21, the low-melting metal 29 is welded to the connection portion 27 formed of a base material to thereby form the fusible portion 25, and the low-melting metal 29 and the connection portion 27 are made to project so that the protrusions 31 and 31 are provided in this fusible portion 25. Accordingly, it is possible to increase the amount of the low-melting metal 29 without increasing the width of the connection portion 27. Accordingly, the fusing sensibility in a low current range is improved without changing the fusing-off properties in a dead short-circuit range, so that it is possible to shorten only the fusing-off time in a layer short-circuit range.

In addition, according to the above-mentioned fuse manufacturing method, the fuse 21 can be manufactured by forming the groove 43 in the surface of the plate-like base material 41, pouring the melted low-melting metal 29 into the groove 45 so as to weld the low-melting metal 29 thereto, and integrally punching out the portions of the plate-like base material 41 disposed on the opposite sides of the groove 43, the low-melting metal 29, the bottom plate portion 45*a*, and the protrusions 31 and 31.

Although the above description has been made about the case where a pair of protrusions 31 and 31 are provided in the fusible portion 25 in the above-mentioned fuse 21, a single protrusion 31 may be provided in the fusible portion 25 in the fuse 21 according to the present invention. In addition, the shape of the protrusion may be rectangular, triangular, or the like, other than half-circular as mentioned above.

As has been described in detail, in the fuse according to the present invention, a fusible portion is constituted by the connection portion connecting a pair of terminals integrally, and a low-melting metal is stacked by welding on this connection portion, and the connection portion and the low-melting metal are made to project so as to form protrusions in the fusible portion. Accordingly, it is possible to increase the amount of the low-melting metal without increasing the width of the connection portion. Accordingly, it is possible to obtain superior fusing-off property in which only the fusing-off time in a layer short-circuit range can be shortened without changing the fusing-off property in a dead short-circuit range.

When copper or a copper alloy is used as the material for the connection portion and tin is used as the material for the low-melting metal, it is possible to manufacture the fuse having the above-mentioned fusing-off properties with relatively inexpensive materials.

In the method of manufacturing a fuse according to the present invention, a fuse can be manufactured by pouring a melted low-melting metal into a groove of a plate-like base material so as to weld the low-melting metal thereto, and integrally punching out portions of a plate-like base material disposed on the opposite sides of the groove, the low-melting metal, a bottom plate portion, and protrusions. Accordingly, it is possible to eliminate steps such as application of flux, caulking, heating and melting a low-melting chip, cleaning the flux, etc. which have been required in the conventional method. As a result, it is possible to reduce the manufacturing cost by simplifying the manufacturing process.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A fuse comprising:

a pair of terminals fabricated from a base material; and a fusible portion including (1) a connection portion fabricated from said base material and connecting said pair of terminals to each other, said connection portion defining a protrusion, and (2) a low-melting metal portion fabricated from a second material having a lower melting point than that of said base material, said low-melting metal portion stacked on said protrusion of said connection portion;

wherein said connection portion and said low-melting metal portion project in a direction parallel to the plane of an interface between said connection portion and said lowmelting-metal portion; and wherein said protrusion is thinner than a remainder of said connection portion not including said protrusion.

2. A fuse according to claim 1, wherein said base material is selected from the group consisting of copper, copper alloy, zinc, and zinc alloy, and said second material is selected from the group consisting of tin, gold, and nickel.

3. A fuse according to claim 1, wherein said protrusion projects in a direction parallel to a plane of an interface between said connection portion and said low-melting metal portion.

4. A fuse according to claim 1, wherein said protrusion is formed at a center of said connection portion.

5. A fuse according to claim 1, wherein said fusible portion has a substantially uniform thickness across an entire length thereof.

6. A fuse according to claim 1, wherein said connection portion defines a plane in which said protrusion protrudes.

* * * * *